US011077492B2

(12) United States Patent
Toishi et al.

(10) Patent No.: US 11,077,492 B2
(45) Date of Patent: Aug. 3, 2021

(54) CONTINUOUS STEEL CASTING METHOD

(71) Applicant: JFE Steel Corporation, Tokyo (JP)

(72) Inventors: Keigo Toishi, Tokyo (JP); Yutaka Awajiya, Tokyo (JP); Norichika Aramaki, Tokyo (JP); Naoki Kikuchi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 16/975,793

(22) PCT Filed: Feb. 25, 2019

(86) PCT No.: PCT/JP2019/006939
§ 371 (c)(1),
(2) Date: Aug. 26, 2020

(87) PCT Pub. No.: WO2019/167855
PCT Pub. Date: Sep. 6, 2019

(65) Prior Publication Data

US 2020/0406342 A1 Dec. 31, 2020

(30) Foreign Application Priority Data

Mar. 2, 2018 (JP) ..... JP2018-037079

(51) Int. Cl.
*B22D 11/128* (2006.01)
*B22D 11/041* (2006.01)

(52) U.S. Cl.
CPC ..... *B22D 11/1287* (2013.01); *B22D 11/041* (2013.01)

(58) Field of Classification Search
CPC ... B22D 11/1287; B22D 11/041; B22D 11/16; B22D 11/12; B22D 11/1206
See application file for complete search history.

(56) References Cited

FOREIGN PATENT DOCUMENTS

| | | | |
|---|---|---|---|
| CN | 101778682 | A | 7/2010 |
| CN | 102335733 | A | 2/2012 |
| CN | 104507598 | A | 4/2015 |

(Continued)

OTHER PUBLICATIONS

English Machine Translation of JP2014039940A (Year: 2014).*

(Continued)

*Primary Examiner* — Kevin P Kerns
*Assistant Examiner* — Steven S Ha
(74) *Attorney, Agent, or Firm* — RatnerPrestia

(57) ABSTRACT

In the continuous steel casting method of the present invention, a gap between strand support rolls with a strand in a rectangular shape interposed therebetween is increased toward a downstream side in a casting direction to thereby bulge the strand having an unsolidified layer thereinside such that the thickness between long-side surfaces of the strand increases within the range of 0.1% or more and 10% or less of the thickness of the strand inside a mold. A portion of the strand in which the solid phase fraction in a central portion of the strand is within the range of 0.2 or more and less than 0.9 satisfies a prescribed total rolling reduction and a prescribed reduction gradient, and a portion of the strand in which the solid phase fraction is within the range of 0.9 or more satisfies a prescribed total rolling reduction and a prescribed reduction gradient.

1 Claim, 3 Drawing Sheets

(56) References Cited

FOREIGN PATENT DOCUMENTS

| | | | |
|---|---|---|---|
| CN | 107000045 | A | 8/2017 |
| EP | 2174734 | A1 | 4/2010 |
| EP | 2881196 | A1 | 6/2015 |
| EP | 3219408 | A1 | 9/2017 |
| EP | 3251774 | A1 | 12/2017 |
| JP | 0957410 | A | 3/1997 |
| JP | 11156511 | A | 6/1999 |
| JP | 2000288705 | A | 10/2000 |
| JP | 2001334353 | A | 12/2001 |
| JP | 2007296542 | A | 11/2007 |
| JP | 2014039940 | A | 3/2014 |
| JP | 2014233726 | A | 12/2014 |
| JP | 2015202510 | A | 11/2015 |
| JP | 2015226918 | A | 12/2015 |
| JP | 2016019993 | A | 2/2016 |
| JP | 2017024079 | A | 2/2017 |
| TW | 201634150 | A1 | 10/2016 |

OTHER PUBLICATIONS

Narita et al., "Effect of Deformation on the Formation of Internal Cracks in Continuously Cast Blooms", Tetsu-to-Hagane, 1981, vol. 67, No. 8, pp. 1307-1316.

International Search Report and Written Opinion for International Application No. PCT/JP2019/006939, dated Apr. 2, 2019, 7 pages.

Extended European Search Report for European Application No. 19 760 827.6, dated Nov. 25, 2020, 8 pages.

Taiwanese Office Action with Search Report for Taiwanese Application No. 108106399, dated Dec. 30, 2019, 4 pages.

Ohnaka, "Introduction to Heat Transfer and Soldification Analysis by Computers, Applications to Casting Process", Maruzen Co., Ltd., 1985, 2 pages.

Japanese Office Action for Japanese Application No. 2019-544929, dated Jun. 17, 2020 with Concise Statement of Relevance of Office Action, 5 pages.

Chinese Office Action for Chinese Application No. 201980016126.9, dated May 8, 2021 with Concise Statement of Relevance of Office Action, 8 pages.

* cited by examiner

CONTINUOUS STEEL CASTING METHOD

CROSS REFERENCE TO RELATED APPLICATIONS

This is the U.S. National Phase application of PCT/JP2019/006939, filed Feb. 25, 2019, which claims priority to Japanese Patent Application No. 2018-037079, filed Mar. 2, 2018, the disclosures of these applications being incorporated herein by reference in their entireties for all purposes.

FIELD OF THE INVENTION

The present invention relates to a continuous steel casting method in which the porosity formation and component segregation that occur in a central portion of a strand during continuous casting are prevented.

BACKGROUND OF THE INVENTION

In the process of solidification during continuous casting, solidification shrinkage occurs. The solidification shrinkage causes unsolidified molten steel to be drawn and flow in the withdrawal direction of the strand. In the unsolidified molten steel, solute elements such as C, P, Mn, and S are concentrated (the unsolidified molten steel is referred to as concentrated molten steel). When the flow of the concentrated molten steel occurs, the solute elements solidify in a central portion of the slab, causing center segregation. The causes of the flow of the concentrated molten steel in the final stage of solidification include, in addition to the solidification shrinkage described above, bulging of the strand between rolls due to the ferrostatic pressure of the molten steel and roll alignment mismatches between strand support rolls.

The center segregation causes deterioration in the quality of steel products, particularly steel plates. For example, in line pipe materials for oil transportation and natural gas transportation, sour gas causes hydrogen-induced cracking starting from the center segregation. The same problem occurs in marine structures, storage tanks, oil tanks, etc. In recent years, steel materials are often required to be used in severe use environments such as lower temperature environments and more corrosive environments, and the importance of reducing the center segregation of the strand is increasing.

Therefore, many measures directed toward reducing the center segregation or the porosity in a strand have been proposed over process steps from the continuous casting step to the rolling step. Among them, one effective method is to cast a strand that is in the final stage of solidification and has an unsolidified layer while the strand is gradually rolled using a plurality of pairs of strand support rolls (this method is referred to as a "soft reduction method in the final stage of solidification"). In another effective method, a strand that is in the final stage of solidification and has an unsolidified layer is rolled by about 10 mm or more using one pair or 2 or 3 pairs of reduction rolls (this method is referred to as a "large reduction method in the final stage of solidification").

The soft reduction method in the final stage of solidification is the following technique. Reduction rolls are disposed in the casting direction in a zone close to a solidification completion position of the strand (this zone is referred to as a "soft reduction zone"), and a strand is gradually rolled during continuous casting using the reduction rolls at a rolling reduction rate (0.3 to 1.5 mm/min) approximately corresponding to the amount of solidification shrinkage. In this manner, the formation of voids in a central portion of the strand and the flow of the concentrated molten steel are prevented, and the center segregation of the strand is thereby reduced. The large reduction method in the final stage of solidification is a technique in which a strand is rolled using one pair or 2 or 3 pairs of reduction rolls disposed in a zone close to a solidification completion position of the strand to push out the concentrated molten steel present between dendrite arms toward the upstream side in the casting direction to thereby reduce the center segregation of the strand.

In the soft reduction in the final stage of solidification, if the amount of rolling reduction is insufficient, center segregation and the formation of internal defects are not prevented sufficiently. If the amount of rolling reduction is excessively large, internal cracking occurs, and the internal quality of the strand deteriorates. Therefore, in the soft reduction in the final stage of solidification, it is important to control the amount of rolling reduction within an appropriate range. However, when the strand is actually subjected to soft reduction, a large load is applied to soft reduction segments and may cause the segments to deform, so that an appropriate rolling reduction may not be obtained. If the rolling reduction is insufficient, porosity remain present, and it is feared that UT defects may occur.

Patent Literature 1 discloses a large reduction method in the final stage of solidification. In this method, a strand is intentionally bulged by 3% or more and 25% or less of the thickness of the strand at the start of bulging. Then a portion of the strand in which the solid phase fraction in its central portion is from 0.2 to 0.7 is rolled by a thickness reduction corresponding to from 30% to 70% of the amount of bulging using a pair of reduction rolls. Patent Literature 2 discloses a large reduction method in the final stage of solidification. In this method, guide rolls disposed in a prescribed region between a position corresponding to a liquidus crater end of a strand and a position corresponding to its solidus crater end are such that the gap between the guide rolls in the thickness direction of the strand (its short side direction) is increased. In this case, the strand is intentionally bulged by a total of 5 mm to less than 20 mm. Then, a portion of the strand in which the solid phase fraction in the central portion of the strand is 0.1 to 0.8 is rolled at a reduction of 0.5 to 1.0 times the amount of bulging using at least one pair of reduction rolls to thereby reduce center segregation. In Patent Literature 1 and Patent Literature 2, the amount of intentional bulging is large, and it is therefore feared that cracking may occur in the strand when the strand is intentionally bulged. Moreover, since the reduction per reduction roll is large, a robust rolling facility that can withstand a high load is necessary. Therefore, the cost of the facility is high, and it is feared that internal cracking may occur in the strand during rolling. Moreover, when the rolling reduction relative to the increase in the gap between the rolls is insufficient, porosity may remain present in the central portion of the strand.

Patent Literature 3 discloses a rolling method in which bulging and convex rolls are utilized. In Patent Literature 3, as in Patent Literature 1 and Patent Literature 2, the amount of bulging is large, and there is a possibility that internal cracking may occur. Moreover, there is a risk of internal cracking when solidification interfaces are compression-bonded by second rolling.

Patent Literature 4 discloses a method for reducing the porosity by rolling a widthwise central portion of a strand including an unsolidified portion in a region in which the solid phase fraction in a thicknesswise central portion of the strand is 0.8 or more and less than 1.0. However, in Patent Literature 4, as in Patent Literature 1, the rolling reduction per reduction roll is large, and a robust rolling facility that can withstand a high load is necessary. Therefore, the cost of the facility is high, and it is feared that internal cracking may occur in the strand during rolling.

PATENT LITERATURE

PTL 1: Japanese Unexamined Patent Application Publication No. 2000-288705

PTL 2: Japanese Unexamined Patent Application Publication No. 11-156511

PTL 3: Japanese Unexamined Patent Application Publication No. 2001-334353

PTL 4: Japanese Unexamined Patent Application Publication No. 2007-296542

NON PATENT LITERATURE

NPL 1: OHNAKA Itsuo, "Introduction to Heat Transfer and Solidification Analysis by Computers, Applications to Casting Processes," MARUZEN Co., Ltd. (Tokyo), 1985, p. 201-202

SUMMARY OF THE INVENTION

Aspects of the present invention have been made in view of the foregoing problems, and it is an object to provide a continuous steel casting method in which the amount $D_0$ of intentional bulging of the strand (the increase in the thickness of the strand) formed using guide rolls is adjusted to 10% or less of the thickness of the strand at the outlet of a mold to prevent the occurrence of internal cracking and the porosity formation, in which, while the total rolling reduction is prescribed, soft reduction is applied, so that center segregation can be effectively reduced using a relatively small rolling load without using a facility with high rolling ability, and in which remaining porosity is eliminated by stepwise rolling after solidification.

The features according to aspects of the present invention that solve the foregoing problems are as follows.

[1] A continuous steel casting method, wherein, during continuous casting of steel, a gap between strand support rolls facing each other with a strand in a rectangular shape interposed therebetween is increased toward a downstream side in a casting direction to thereby bulge the strand having an unsolidified layer thereinside such that a thickness between long-side surfaces of the strand increases within the range of 0.1% or more and 10% or less of the thickness of the strand inside a mold, and wherein, when the long-side surfaces of the bulged strand are rolled by a plurality of guide rolls, a total rolling reduction and a reduction gradient satisfy formulas (1) and (2) below when a solid phase fraction in a central portion of the strand is within the range of 0.2 or more and less than 0.9, and the total rolling reduction and the reduction gradient satisfy formulas (3) and (4) below when the solid phase fraction in the central portion of the strand is within the range of 0.9 or more:

$$0.5 \le R_{t1}/D_0 \le 1.0, \quad (1)$$

$$0.5 \le R_{g1} \le 3.0, \quad (2)$$

$$0.2 \le R_{t2}/D_0 \le 1.0, \quad (3)$$

$$0.1 \le R_{g2} \le 1.5, \quad (4)$$

where $R_{t1}$: the total rolling reduction (mm) of the strand when the solid phase fraction is within the range of 0.2 or more and less than 0.9, $D_0$: the amount of bulging (mm) of the strand, $R_{g1}$: the reduction gradient (mm/m) of the strand when the solid phase fraction is within the range of 0.2 or more and less than 0.9, $R_{t2}$: the total rolling reduction (mm) of the strand when the solid phase fraction is within the range of 0.9 or more, and $R_{g2}$: the reduction gradient (mm/m) of the strand when the solid phase fraction is within the range of 0.9 or more.

By applying the continuous steel casting method according to aspects of the present invention, the strand can be subjected to soft reduction while the total rolling reduction is prescribed without the occurrence of cracking and the porosity formation inside the strand, so that center segregation can be effectively reduced using a relatively small rolling load without using a facility with high rolling ability. The solidified strand is then continuously rolled stepwise before the temperature of the central portion of the strand is reduced largely. Therefore, remaining porosity can be compression-bonded using a smaller rolling load, so that the occurrence of internal cracking can be prevented.

DETAILED DESCRIPTION OF EMBODIMENTS OF THE INVENTION

Figure 1:
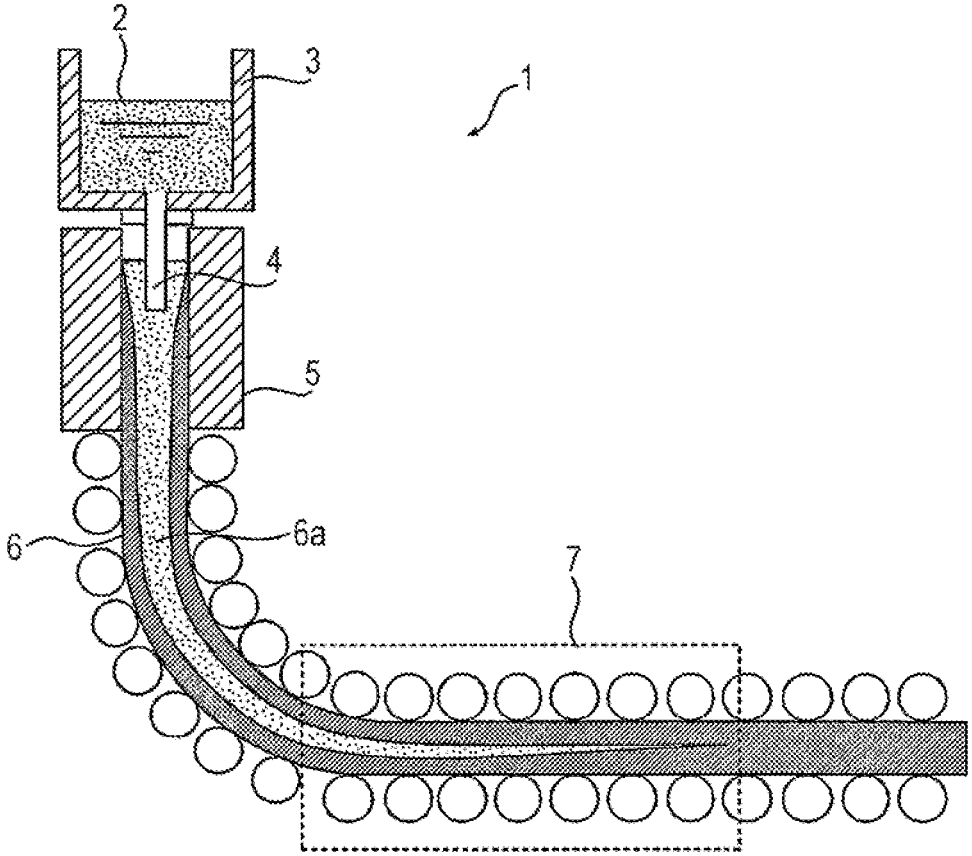
FIG. 1 is a schematic illustration showing a continuous casting machine to which a continuous steel casting method according to an embodiment of the present invention is applied.

In the continuous steel casting method according to aspects of the present invention, a gap between strand support rolls facing each other with a strand in a rectangular shape interposed therebetween is increased toward a downstream side in a casting direction to thereby bulge the strand having an unsolidified layer thereinside such that a thickness between long-side surfaces of the strand increases within the range of 0.1% or more and 10% or less of the thickness of the strand inside a mold. When the long-side surfaces of the bulged strand are rolled by a plurality of guide rolls, a total rolling reduction and a reduction gradient satisfy formulas (1) and (2) below when a solid phase fraction in a central portion of the strand is within the range of 0.2 or more and less than 0.9, and the total rolling reduction and the reduction gradient satisfy formulas (3) and (4) below when the solid phase fraction in the central portion of the strand is within the range of 0.9 or more:

$$0.5 \le R_{t1}/D_0 \le 1.0, \quad (1)$$

$$0.5 \le R_{g1} \le 3.0, \quad (2)$$

$$0.2 \le R_{t2}/D_0 \le 1.0, \quad (3)$$

$$0.1 \le R_{g2} \le 1.5 \quad (4)$$

where $R_{t1}$: the total rolling reduction (mm) of the strand when the solid phase fraction is within the range of 0.2 or more and less than 0.9, $D_0$: the amount of bulging (mm) of the strand, $R_{g1}$: the reduction gradient (mm/m) of the strand when the solid phase fraction is within the range of 0.2 or more and less than 0.9, $R_{t2}$: the total rolling reduction (mm) of the strand when the solid phase fraction is within the range of 0.9 or more, and $R_{g2}$: the reduction gradient (mm/m) of the strand when the solid phase fraction is within the range of 0.9 or more.

Figure 3:
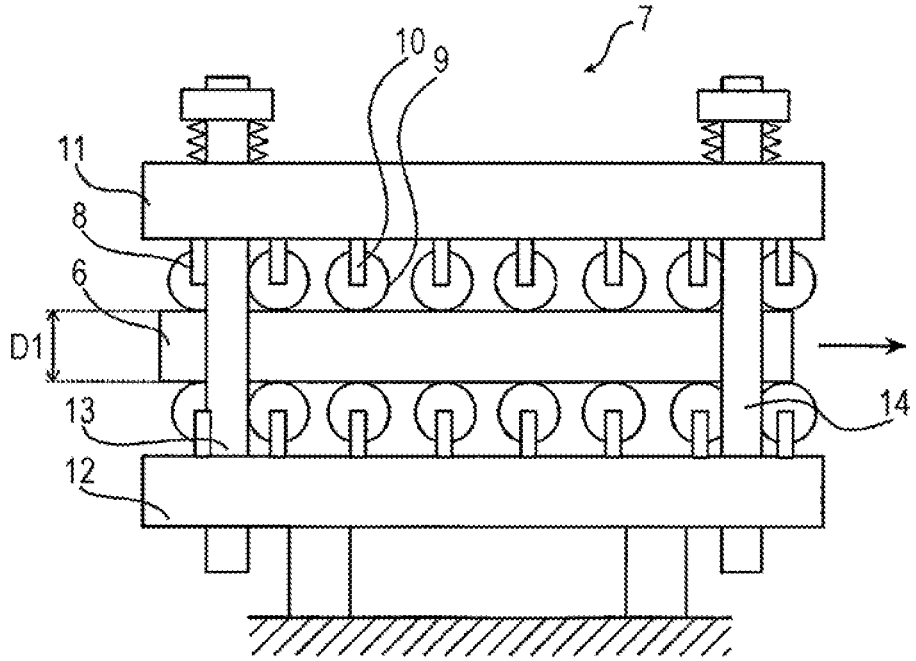
FIG. 3 is a side view of soft reduction segments in a plane perpendicular to a conveying direction.

An example of a continuous steel casting method according to an embodiment of the present invention will be described with reference to the drawings. In FIG. 3, the casting direction is indicated by an arrow.

FIG. 1 is a schematic illustration showing a continuous casting machine 1 to which the continuous steel casting method according to the embodiment of the present invention is applied. As shown in FIG. 1, the continuous casting machine 1 includes a tundish 3 into which molten steel 2 is poured from a molten steel ladle, a copper-made mold 5 that cools the molten steel 2 poured from the tundish 3 through a submerged nozzle 4, and a plurality of segments 7 that convey a semi-solidified strand 6 withdrawn from the mold 5. The semi-solidified strand 6 includes thereinside an unsolidified layer 6*a*.

Figure 2:
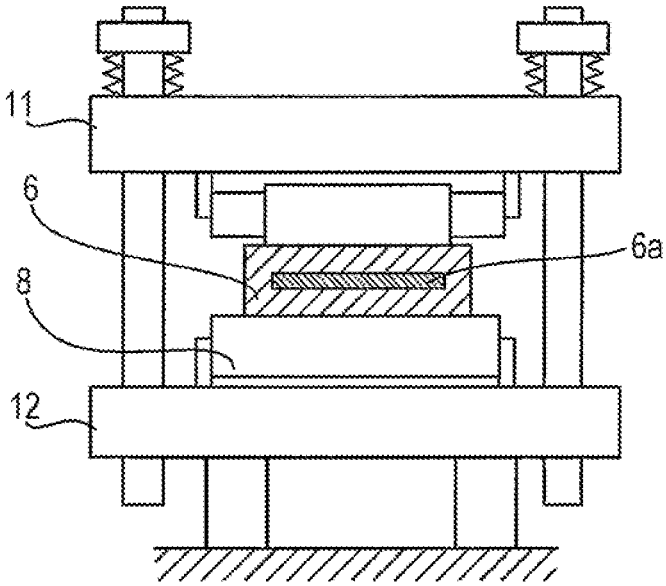
FIG. 2 is an enlarged schematic illustration showing a soft reduction segment in the continuous casting machine.

FIG. 2 is an enlarged schematic illustration of a segment 7 in the continuous casting machine 1, and FIG. 3 is a side view of the segments 7 in a plane perpendicular to the conveying direction of the strand 6. As shown in FIGS. 2 and 3, the segments 7 include driving rolls 8 that apply a pressing force to the strand 6 and guide rolls 9. Each of the guide rolls is fixed to an upper frame 11 or a lower frame 12 through a bearing 10. The upper frame 11 and the lower frame 12 are supported by an upstream strut 13 and a downstream strut 14. The driving rolls and the guide rolls are collectively referred to as strand support rolls. The strand support rolls are disposed at positions facing each other with the strand 6 interposed therebetween.

Since the upper frame 11 and the lower frame 12 are supported by the upstream strut 13 and the downstream strut 14, the upstream strut 13 and the downstream strut 14 determine the amount of soft reduction applied to the strand 6 by the segments 7 as a whole. Since each of the plurality of guide rolls 9 is fixed to the upper frame 11 or the lower frame 12 through a corresponding bearing as described above, the gap between the upper guide rolls and the lower guide rolls can be adjusted by extending or contracting the length of the struts using, for example, a worm jack. By setting the roll gap of a segment to be larger than the roll gap of a segment immediately upstream thereof, the amount of bulging can be set. By setting the gap between guide rolls in the upstream side to be larger than the gap between guide rolls in the downstream side, a soft reduction gradient can be set.

Figure 4:
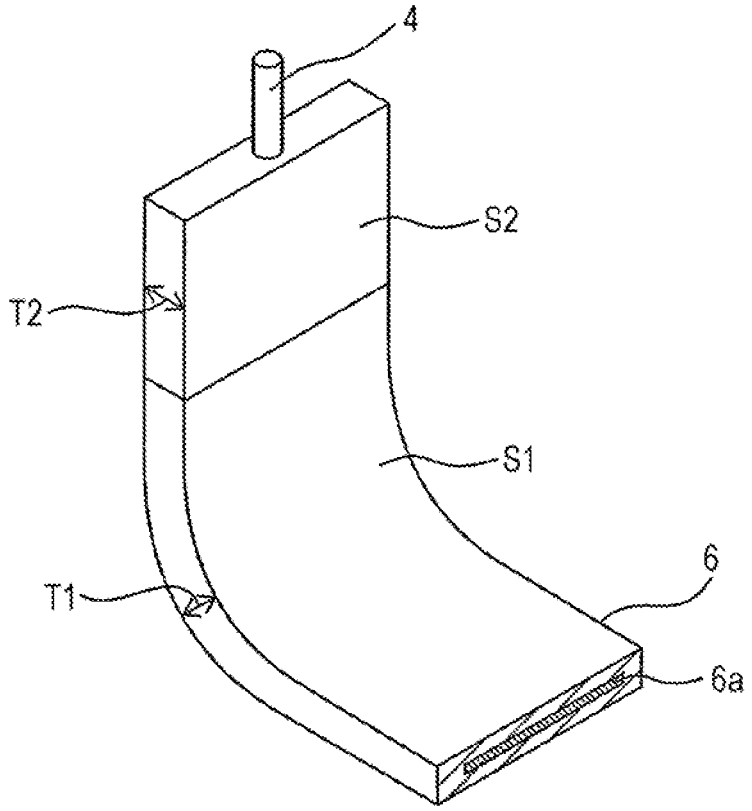
FIG. 4 is a schematic illustration showing a strand.

In the method according to aspects of the present invention, to prevent internal cracking and the porosity formation in the strand, the gap D1 between the strand support rolls facing each other with the strand 6 interposed therebetween is increased toward the downstream side in the casting direction. Therefore, the strand 6 in a rectangular shape having the unsolidified layer 6*a* thereinside is bulged such that the thickness T1 between the long-side surfaces of the strand 6 increases within the range of from 0.1% to 10% of the thickness T2 of the strand in the mold 5. FIG. 4 is a schematic illustration showing the strand 6 (a perspective view of the strand 6), and a surface S2 of the strand 6 in the mold 5, the thickness T2 of the strand 6 in the mold 5, a long-side surface S1 of the strand 6, and the thickness T1 between the long-side surfaces of the strand 6 are shown with their symbols. The bulging in accordance with aspects of the present invention is intentional building and is hereinafter referred to simply as "bulging." The reason that the amount of bulging is set to 0.1% or more is that 0.1% is an estimate of the minimum necessary amount of bulging necessary to prevent an excessively large load from being applied to the strand, and the reason that the amount of bulging is set to 10% or less is to prevent excessive internal strain caused by the intentional bulging to thereby prevent internal cracking. The intentional bulging is started at a point where the solid phase fraction in the central portion is 0 and is stopped when the amount of bulging reaches a prescribed amount that is within the range of from 0.1% to 10% (preferably from 1% to 5%) of the thickness of the strand in the mold. Preferably, the bulging is stopped in a region in which the solid phase fraction in the central portion is less than 0.1.

After the bulging of the strand, the long-side surfaces of the strand are rolled using a plurality of guide rolls. In this case, a portion of the strand in which the solid phase fraction in the thicknesswise central portion of the strand is 0.2 or more and less than 0.9 is rolled using guide rolls by an amount of 50% or more and 100% or less of the amount of bulging. The solid phase fraction in the thicknesswise central portion of the strand (hereinafter referred to simply as the "solid phase fraction in the central portion" or the "solid phase fraction") is the solid phase fraction on a center line in the thickness direction in the strand excluding widthwise edges and may be typified by the solid phase fraction in a portion at the widthwise center (and the thicknesswise center) of the strand. By setting the rolling reduction in the portion in which the solid phase fraction in the central portion is 0.2 or more and less than 0.9 to 50% or more of the amount of bulging, the center segregation in the strand due to the flow of the molten steel in the final stage of solidification can be reduced. By setting the rolling reduction to 100% or less of the amount of bulging, a solidifying shell in fully solidified short-side portions is not rolled, and a rolling load when a portion in which the solid phase fraction is within the range of 0.9 or more is rolled can be reduced. By setting the reduction gradient within the range of 0.5 to 3.0 mm/m, the strand can be rolled at an appropriate rolling rate, and the center segregation can be effectively reduced. Specifically, in the portion in which the solid phase fraction in the central portion is 0.2 or more and less than 0.9, the operation is performed such that formulas (1) and (2) are satisfied.

$$0.5 \leq R_{t1}/D_0 \leq 1.0 \quad (1)$$

$$0.5 \leq R_{g1} \leq 3.0 \quad (2)$$

Here, $R_{t1}$: the total rolling reduction (mm) of the strand when the solid phase fraction is within the range of 0.2 or more and less than 0.9, $D_0$: the amount of bulging (mm) of the strand, and $R_{g1}$: the reduction gradient (mm/m) of the strand when the solid phase fraction is within the range of 0.2 or more and less than 0.9.

When the solid phase fraction is in the range of 0.9 or more, the strand is rolled using guide rolls by an amount of 20% or more and 100% or less of the amount of bulging. By setting the reduction gradient within the range of 0.1 to 1.5 mm/m, the porosity can be effectively reduced while an excessive load is not applied to the segments. Specifically, in the portion in which the solid phase fraction in the central portion is within the range of 0.9 or more, the operation is performed such that formulas (3) and (4) are satisfied. The rolling may be continued after the solid phase fraction in the central portion has reached 1.0. However, the rolling is finished such that the total rolling reduction is within the range defined by formula (3).

$$0.2 \leq R_{r2}/D_0 \leq 1.0 \quad (3)$$

$$0.1 \leq R_{g2} \leq 1.5 \quad (4)$$

Here, $R_{r2}$: the total rolling reduction (mm) of the strand when the solid phase fraction is within the range of 0.9 or more, $D_0$: the amount of bulging (mm) of the strand, and $R_{g2}$: the reduction gradient (mm/m) of the strand when the solid phase fraction is within the range of 0.9 or more.

In the operation of the continuous casting, the effects according to aspects of the present invention can be obtained so long as the operation is performed while the above operating conditions are satisfied. It is more preferable that the operating conditions are controlled such that they fall within the above ranges.

The solid phase fraction in the central portion can be determined in advance by heat transfer-solidification analysis. In the heat transfer-solidification analysis, numerical computations may be performed using, for example, an "enthalpy method" described in Non Patent Literature 1. The accuracy of the heat transfer-solidification analysis was checked in advance by a method such as a rivet pin shooting test, the measurement of surface temperature, or the measurement of the solid phase fraction using ultrasonic waves and was found to be sufficient for embodying aspects of the present invention. The solidification completion point can vary during casting. However, by setting the range of the soft reduction by the guide rolls to be wide, the portion in which the solid phase fraction is 0.9 or less can be prevented from being located outside the rolling reduction range.

EXAMPLES

Examples of the continuous steel casting method according to the embodiment of the present invention will be described. However, the present invention is not limited to the following Examples.

Figure 5:
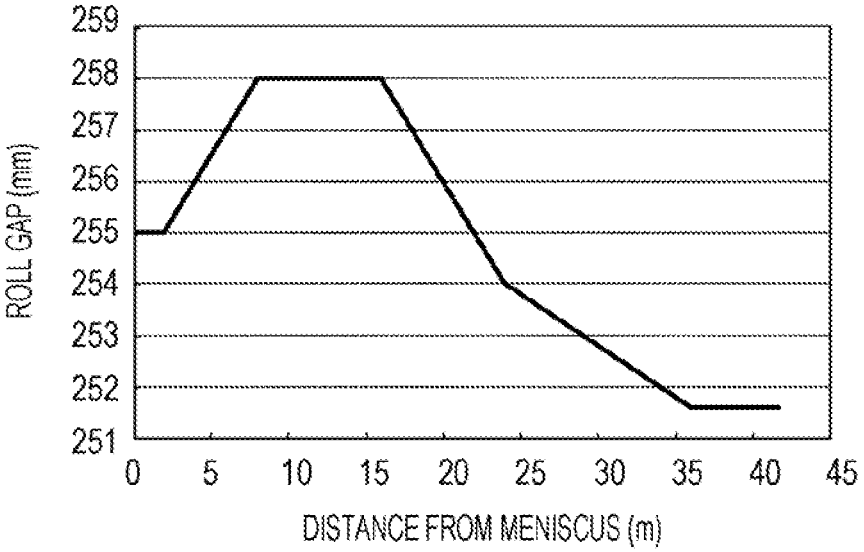
FIG. 5 shows an example of a roll gap in accordance with aspects of the present invention.

A slab continuous casting machine of the same type as the slab continuous casting machine in FIG. 1 was used to perform a test in which low-carbon aluminum-killed steel was subjected to continuous casting. Main components of the steel are C: 0.03 to 0.2% by mass, Si: 0.05 to 0.5% by mass, Mn: 0.8 to 1.8% by mass, P: less than 0.02% by mass, and S: less than 0.005% by mass. As for the size of the strand, the thickness is 250 mm to 300 mm, and the width is 1900 to 2100 mm. The withdrawal speed of the strand is 0.9 to 1.4 m/min. The rolling segments include a pair of driving rolls and guide rolls, and the length of one segment is 2 m. FIG. 5 shows an example of the roll gap in the Examples.

Tables 1 and 2 show casting conditions 1 to 11 in the continuous steel casting method according to the embodiment of the present invention and data on the measurement of the degree of center segregation, porosity, internal cracking, and surface flaws in cast slabs. For comparison, the casting test was conducted under conditions 12 to 20 outside the ranges according to aspects of the present invention.

TABLE 1

| Conditions | Thickness of strand (mm) | Width of strand (mm) | $D_0$ (mm) | $R_{r1}$ (mm) | $R_{g1}$ (mm/m) | $R_{r2}$ (mm) | $R_{g2}$ (mm/m) | $R_{r1}/D_0$ | $R_{r2}/D_0$ | Distance at which fs = 0.2 (m) | Distance at which fs = 0.9 (m) | Remarks |
|---|---|---|---|---|---|---|---|---|---|---|---|---|
| 1 | 250 | 2000 | 6.0 | 5.0 | 0.83 | 5.0 | 0.33 | 0.8 | 0.8 | 20.0 | 24.2 | Present invention |
| 2 | 250 | 2000 | 6.5 | 4.0 | 1.00 | 6.0 | 0.40 | 0.6 | 0.9 | 22.0 | 25.5 | Present invention |
| 3 | 250 | 1900 | 9.2 | 8.0 | 1.00 | 4.5 | 0.30 | 0.9 | 0.5 | 21.5 | 24.8 | Present invention |
| 4 | 250 | 1900 | 8.0 | 7.8 | 0.98 | 7.0 | 0.47 | 1.0 | 0.9 | 21.5 | 24.8 | Present invention |
| 5 | 250 | 1900 | 9.2 | 8.0 | 1.00 | 9.0 | 0.60 | 0.9 | 1.0 | 21.8 | 25.2 | Present invention |
| 6 | 250 | 1900 | 8.0 | 4.0 | 0.50 | 4.5 | 0.30 | 0.5 | 0.6 | 21.9 | 25.1 | Present invention |
| 7 | 250 | 2000 | 6.5 | 5.0 | 0.63 | 1.6 | 0.11 | 0.8 | 0.2 | 22.0 | 25.5 | Present invention |
| 8 | 250 | 2000 | 20.0 | 11.0 | 1.38 | 19.0 | 1.27 | 0.6 | 1.0 | 21.5 | 24.8 | Present invention |
| 9 | 300 | 2000 | 8.1 | 7.0 | 0.88 | 6.0 | 0.40 | 0.9 | 0.7 | 28.5 | 32.2 | Present invention |
| 10 | 300 | 2100 | 25.0 | 23.0 | 2.88 | 10.0 | 0.67 | 0.9 | 0.4 | 29.0 | 31.5 | Present invention |
| 11 | 300 | 2100 | 8.2 | 8.0 | 1.00 | 5.5 | 0.37 | 1.0 | 0.7 | 29.5 | 31.5 | Present invention |
| 12 | 250 | 2000 | 4.0 | 4.0 | 1.00 | 0.0 | 0.00 | 1.0 | 0.0 | 21.0 | 24.2 | Comparative Example |
| 13 | 250 | 2000 | 3.2 | 4.0 | 0.67 | 12.0 | 0.80 | 1.3 | 3.8 | 18.0 | 22.2 | Comparative Example |
| 14 | 250 | 2000 | 25.0 | 15.0 | 2.50 | 24.0 | 1.60 | 0.6 | 1.0 | 18.0 | 22.2 | Comparative Example |
| 15 | 250 | 2000 | 6.2 | 10.0 | 5.00 | 5.0 | 0.33 | 1.6 | 0.8 | 19.5 | 23.0 | Comparative Example |
| 16 | 300 | 2000 | 5.8 | 1.5 | 0.25 | 4.0 | 0.27 | 0.3 | 0.7 | 28.5 | 31.8 | Comparative Example |
| 17 | 250 | 2000 | 8.0 | 3.0 | 0.38 | 7.0 | 0.47 | 0.4 | 0.9 | 21.5 | 23.5 | Comparative Example |
| 18 | 300 | 2000 | 15.0 | 30.0 | 3.75 | 25.0 | 1.67 | 2.0 | 1.7 | 29.2 | 32.6 | Comparative Example |
| 19 | 250 | 1900 | 20.0 | 32.0 | 4.00 | 32.0 | 2.13 | 1.6 | 1.6 | 21.2 | 24.0 | Comparative Example |
| 20 | 300 | 1900 | 10.0 | 31.0 | 3.88 | 26.0 | 1.73 | 3.1 | 2.6 | 29.2 | 32.6 | Comparative Example |

$D_0$: Amount of bulging of strand
$R_{r1}$: Total rolling reduction of strand when solid phase fraction is 0.2 or more and less than 0.9
$R_{g1}$: Reduction gradient of strand when solid phase fraction is 0.2 or more and less than 0.9
$R_{r2}$: Total rolling reduction of strand when solid phase fraction is 0.9 or more
$R_{g2}$: Reduction gradient of strand when solid phase fraction is 0.9 or more
fs: Solid phase fraction

TABLE 2

| Conditions | Degree of center segregation ($C_{max}/C_0$) | Porosity | Internal cracking | Surface flaws | Remarks |
|---|---|---|---|---|---|
| 1 | 1.042 | None | None | None | Present invention |
| 2 | 1.039 | None | None | None | Present invention |
| 3 | 1.046 | None | None | None | Present invention |
| 4 | 1.046 | None | None | None | Present invention |
| 5 | 1.041 | None | None | None | Present invention |
| 6 | 1.052 | None | None | None | Present invention |
| 7 | 1.042 | None | None | None | Present invention |

TABLE 2-continued

| Conditions | Degree of center segregation ($Cmax/C_0$) | Porosity | Internal cracking | Surface flaws | Remarks |
|---|---|---|---|---|---|
| 8 | 1.038 | None | None | None | Present invention |
| 9 | 1.055 | None | None | None | Present invention |
| 10 | 1.040 | None | None | None | Present invention |
| 11 | 1.063 | None | None | None | Present invention |
| 12 | 1.052 | Yes | None | None | Comparative Example |
| 13 | 1.065 | None | Yes | Yes | Comparative Example |
| 14 | 1.062 | None | Yes | Yes | Comparative Example |
| 15 | 1.103 | None | Yes | None | Comparative Example |
| 16 | 1.112 | None | None | None | Comparative Example |
| 17 | 1.103 | Yes | Yes | None | Comparative Example |
| 18 | 1.120 | None | Yes | Yes | Comparative Example |
| 19 | 1.105 | None | Yes | Yes | Comparative Example |
| 20 | 1.103 | None | Yes | Yes | Comparative Example |

To measure the degree of center segregation, the following method was used. The concentration of carbon (% by mass) in a central portion of a cross section of a slab was analyzed in the thickness direction. The maximum value of the carbon concentration was denoted as Cmax, and the average carbon concentration (i.e., the carbon concentration in molten steel) was denoted as $C_0$. $Cmax/C_0$ was defined as the degree of center segregation. Specifically, in this definition, the closer the degree of center segregation is to 1, the lower the center segregation. When the degree of center segregation was 1.10 or more, the center segregation was judged to be poor, and a poor rating was given. Porosity in the strand were judged as follows. A thicknesswise central portion of the slab before rolling was subjected to ultrasonic flaw detection. When porosity with a pore diameter of 2 mm or more was found, the slab was judged to have porosity, and a poor rating was given.

In conditions 1 to 11, all the total rolling reduction and the reduction gradient were within the ranges according to aspects of the present invention. As is clear from the measurement data in Table 2, in conditions 1 to 11 falling within the ranges according to aspects of the present invention, the degree of center segregation was low (less than 1.10). Moreover, no porosity and no internal cracking were found, and no surface flows were found.

In conditions 12 performed as comparative conditions, the casting was performed under the conditions in which rolling was not performed when the solid phase fraction was within the range of 0.9 or more. Since all the total rolling reduction and the reduction gradient of the strand when the solid phase fraction was within the range of 0.2 or more and less than 0.9 were within the ranges according to aspects of the present invention, the degree of center segregation was low, but porosity was formed. In conditions 13, rolling was performed when the solid phase fraction was within the range of 0.9 or more. The total rolling reduction when the solid phase fraction was within the range of 0.2 or more and less than 0.9 and also the total rolling reduction when the solid phase fraction was within the range of 0.9 or more were larger than the ranges according to aspects of the present invention. Therefore, although no porosity was formed, the total rolling reduction was large, and the strain applied to the strand was excessively large, so that internal cracking and surface flaws occurred in part of the strand. In conditions 14, as in conditions 13, the rolling was performed when the solid phase fraction was within the range of 0.9 or more. However, the reduction gradient was larger than the range according to aspects of the present invention. Therefore, although no porosity was formed, internal cracking and surface flows occurred in part of the strand. In conditions 15, the total rolling reduction and the reduction gradient of the strand when the solid phase fraction was within the range of 0.2 or more and less than 0.9 were higher than the ranges according to aspects of the present invention. Therefore, it is considered that an appropriate rolling rate was not applied, so that the degree of center segregation was higher than that in the Examples of the present invention. In conditions 16 and 17, the total rolling reduction and the reduction gradient of the strand when the solid phase fraction was within the range of 0.2 or more and less than 0.9 were lower than the ranges according to aspects of the present invention. Therefore, the degree of center segregation was higher than that in the Examples of the present invention. In conditions 18, 19, and 20, the total rolling reduction and the reduction gradient of the strand when the solid phase fraction was within the range of 0.9 or more and the total rolling reduction and the reduction gradient of the strand when the solid phase fraction was within the range of 0.2 or more and less than 0.9 were out of the ranges according to aspects of the present invention. Therefore, the center segregation was high. Although no porosity was formed, the strain applied to the strand was excessively high, and therefore internal cracking and surface flaws occurred.

REFERENCE SIGNS LIST

1 continuous casting machine
2 molten steel
3 tundish
4 submerged nozzle
5 mold
6 strand
6*a* unsolidified layer
7 segment
8 driving roll
9 guide roll
10 bearing
11 upper frame
12 lower frame
13 upstream strut
14 downstream strut
D1 gap between strand support rolls
S1 long-side surface of strand
S2 surface of strand in mold
T1 thickness between long-side surfaces of strand
T2 thickness of strand in mold

The invention claimed is:

1. A continuous steel casting method, wherein, during continuous casting of steel, a gap between strand support rolls facing each other with a strand in a rectangular shape interposed therebetween is increased toward a downstream side in a casting direction to thereby bulge the strand having an unsolidified layer thereinside such that a thickness between long-side surfaces of the strand increases within the range of 0.1% or more and 10% or less of the thickness of the strand inside a mold, and wherein, when the long-side surfaces of the bulged strand are rolled by a plurality of guide rolls, a total rolling reduction and a reduction gradient satisfy formulas (1) and (2) below when a solid phase fraction in a central portion of the strand is within the range of 0.2 or more and less than 0.9, and the total rolling reduction and the reduction gradient satisfy formulas (3) and (4) below when the solid phase fraction in the central portion of the strand is within the range of 0.9 or more:

$$0.5 \leq R_{t1}/D_0 \leq 1.0, \quad (1)$$

$$0.5 \leq R_{g1} \leq 3.0, \quad (2)$$

$$0.2 \leq R_{t2}/D_0 \leq 1.0, \quad (3)$$

$$0.1 \leq R_{g2} \leq 1.5, \quad (4)$$

where $R_{t1}$: the total rolling reduction (mm) of the strand when the solid phase fraction is within the range of 0.2 or more and less than 0.9, $D_0$: the amount of bulging (mm) of the strand, $R_{g1}$: the reduction gradient (mm/m) of the strand when the solid phase fraction is within the range of 0.2 or more and less than 0.9, $R_{t2}$: the total rolling reduction (mm) of the strand when the solid phase fraction is within the range of 0.9 or more, and $R_{g2}$: the reduction gradient (mm/m) of the strand when the solid phase fraction is within the range of 0.9 or more.

* * * * *